United States Patent [19]

Johnson

[11] Patent Number: 4,628,627

[45] Date of Patent: Dec. 16, 1986

[54] PROTECTIVE RETAINER FOR A MAGAZINE

[76] Inventor: David A. Johnson, 3432 Tanglewood Way, Salem, Oreg. 97302

[21] Appl. No.: 799,660

[22] Filed: Nov. 19, 1985

[51] Int. Cl.[4] ..... F41C 27/00

[52] U.S. Cl. ..... 42/90

[58] Field of Search ..... 42/90, 18, 50

[56] References Cited

U.S. PATENT DOCUMENTS

| | | | |
|---|---|---|---|
| 2,130,383 | 9/1938 | End | 42/18 |
| 4,100,694 | 7/1978 | Musgrave | 42/90 |
| 4,115,943 | 9/1978 | Musgrave | 42/90 |
| 4,484,403 | 11/1984 | Schwaller | 42/50 |
| 4,484,404 | 11/1984 | Johnson | 42/90 |
| 4,528,765 | 7/1985 | Johnson | 42/1 LP |

*Primary Examiner*—Charles T. Jordan

*Attorney, Agent, or Firm*—Chernoff, Vilhauer, McClung & Stenzel

[57] ABSTRACT

A device for protectively covering the upper end of a spare magazine for a repeating firearm, holding the upper end in a position laterally adjacent the magazine well of the firearm, while a separate lower portion of the device holds the lower end of the spare magazine in a predetermined position relative to a service magazine or other object held in the magazine well of the firearm. When the service magazine or other object is released from the magazine well the spare magazine is freed from the holder, to be inserted into the magazine well. In one embodiment of the invention the lower portion is fixedly mounted on an externally visible safety device which fits releasably into the magazine well of the firearm and prevents it from being fired.

26 Claims, 21 Drawing Figures

FIG. 1
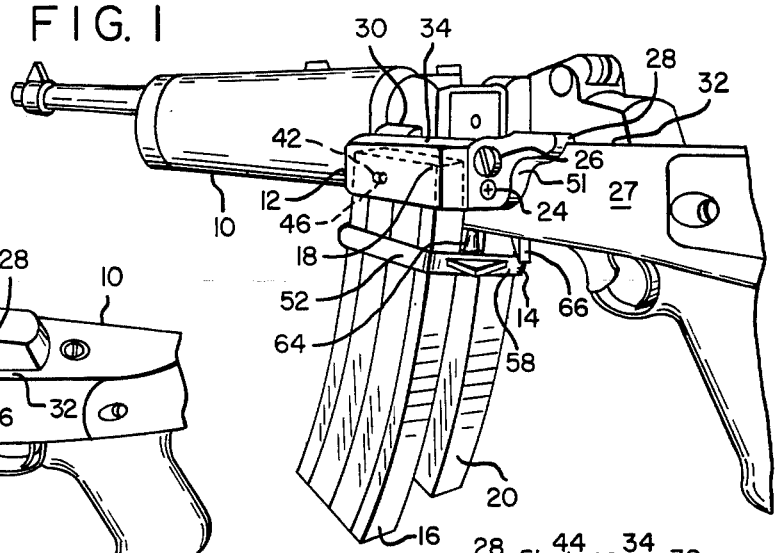
FIG. 2
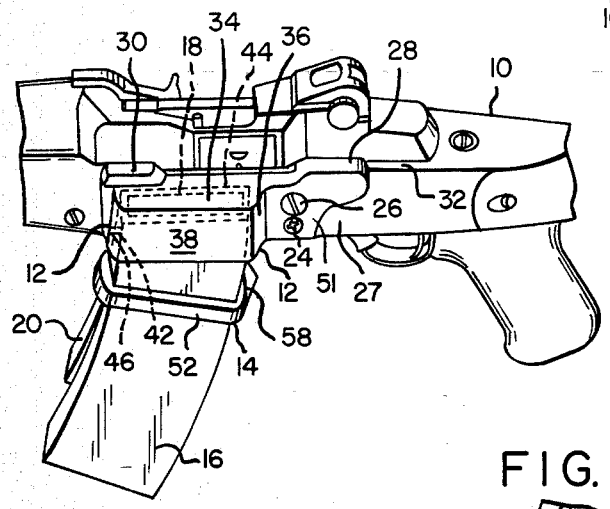
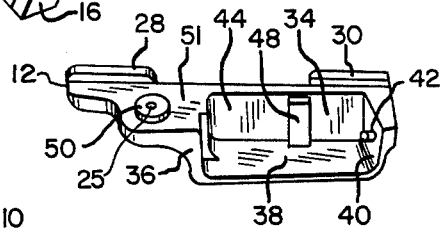
FIG. 3
FIG. 4
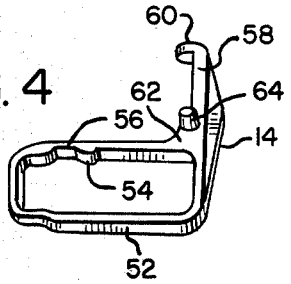
FIG. 5
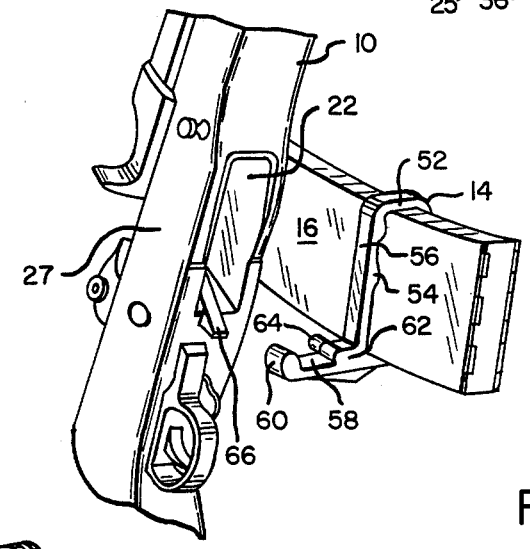
FIG. 6
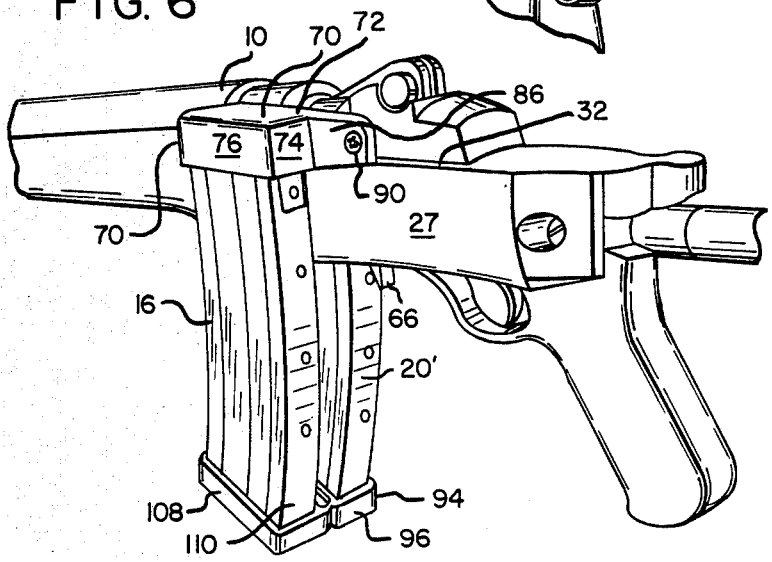
FIG. 7
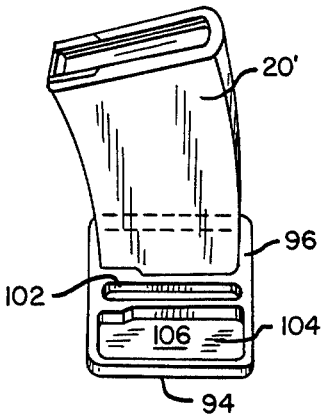

FIG. 8
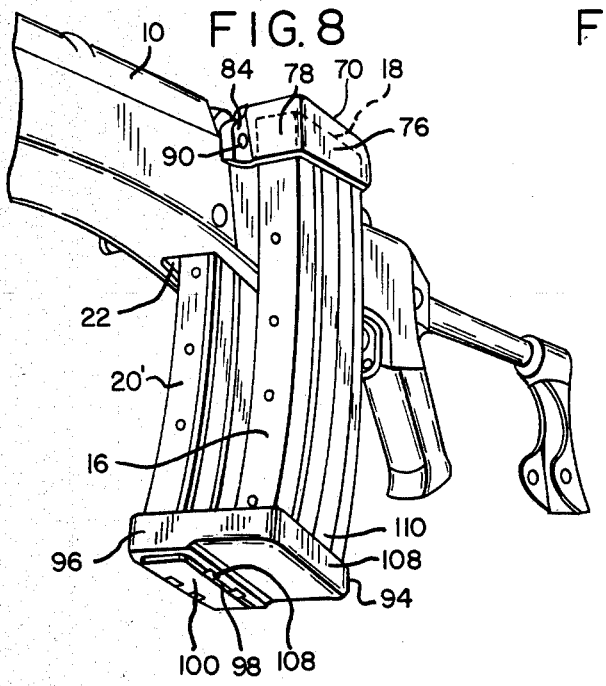
FIG. 9
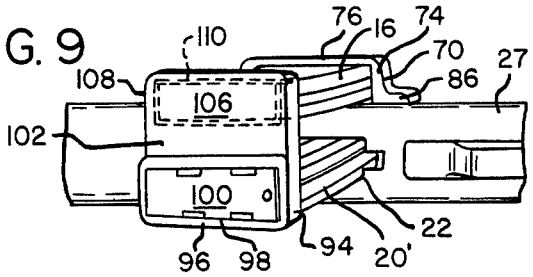
FIG. 10
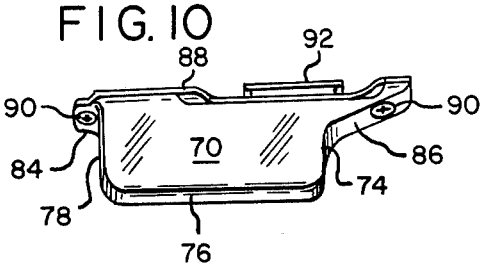
FIG. 11
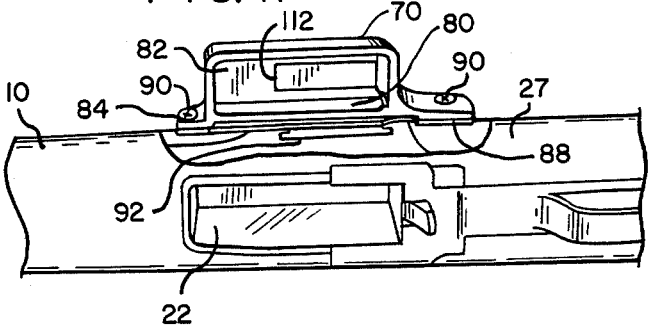
FIG. 13
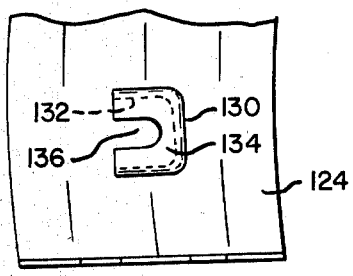
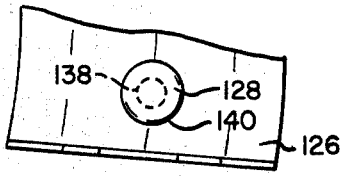
FIG. 14
FIG. 12
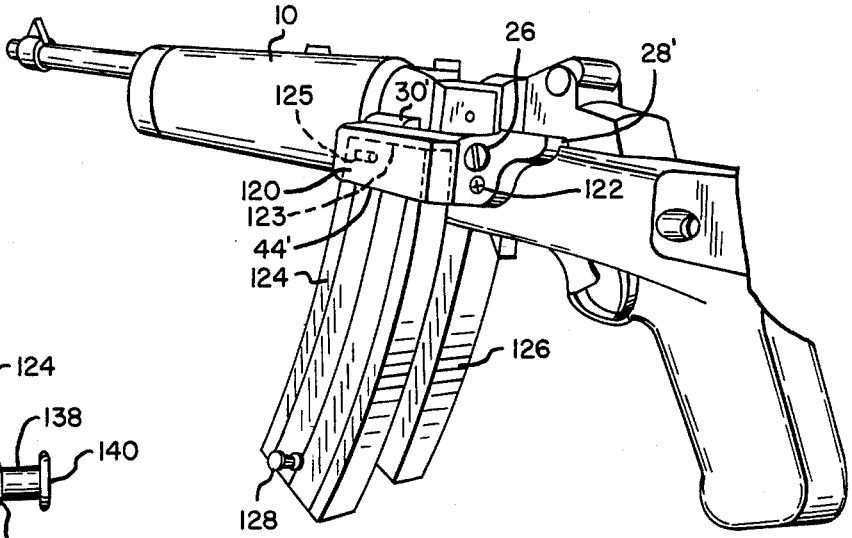
FIG. 15
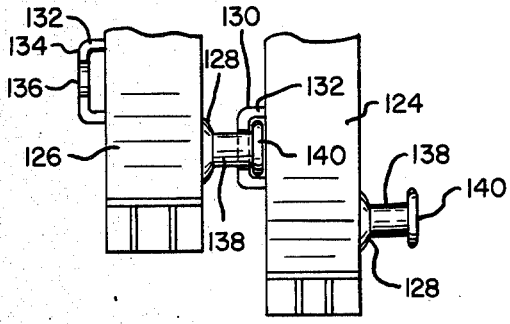

PROTECTIVE RETAINER FOR A MAGAZINE

BACKGROUND OF THE INVENTION

The present invention relates to repeating firearms, and particularly to an accessory for holding a loaded replaceable magazine closely alongside the place where a magazine is actually used in such a firearm.

In land warfare the individual infantry soldier is still an important part of military operations. The effectiveness of infantry operations depends to a large extent on the accuracy, rate of fire and number of rounds of ammunition which each individual soldier is capable of providing. Modern infantry weapons are capable of high cyclic rates of fire and are usually equipped to use magazines capable of holding dozens of cartridges. Such magazines usually must be manually released from a magazine well of the associated weapon when empty, and a full magazine must then be inserted into the weapon before firing may be continued. In order to be capable of sustained firing, an infantry soldier carries loaded spare magazines, typically carrying them in protective pouches attached to ammunition belts worn on the body. When actually engaged in combat, soldiers commonly carry spare magazines ready for immediate use, as removal of a loaded magazine from a cartridge belt may take an undesirably long time.

The ability to reload a weapon quickly also is important in police work, where a police officer normally is not provided with a large supply of ammunition and may be involved in a shooting situation with little or no support from others.

Yet another situation occurs where soldiers are undergoing training and it is desired that weapons be kept safe until a certain point at which it may actually become necessary to fire weapons quickly. Many military weapons may be kept verifiably safe using a device such as that disclosed by Johnson U.S. Pat. No. 4,528,765. However, it is still necessary to provide a magazine readily and safely available for such circumstances.

Because of the clumsiness of carrying a loaded spare magazine in one's hand, devices have been designed to enable spare magazines to be carried attached to a weapon, or attached to a service magazine actually mounted in a repeating firearm. For example, pairs of magazines have been welded together side by side, in opposing orientation. This requires a pair to be turned over, after the first magazine has been emptied and released from the weapon, before the second magazine can be inserted into the weapon for use. This procedure takes an undesireably long amount of time, is awkward, and results in each welded pair of magazines being twice as heavy and clumsy to carry as a single spare magazine. Additionally, the end of the loaded spare magazine which will have to be inserted into the weapon is left exposed and downwardly open, presenting the possibility of a cartridge being damaged or dislodged, or of dirt entering the magazine and being subsequently carried into the action of the firearm with potentially disastrous results.

The magazines used with most automatic-loading firearms retain the cartridges in such a way that they are not completely covered, but are exposed and presented one by one to be loaded into the firing chamber of the weapon from one end of the magazine. Any sand, mud, or other dirt or debris which is carried into the operating mechanism of the firearm by a spare magazine which has been carried unprotected is likely to result in malfunctioning of the weapon during use of the spare magazine. In a combat situation such a failure of the weapon is likely to be fatal.

While a longer period of sustained fire might be provided by simply using a larger magazine with a weapon, this solution is workable only so long as the increased size of the magazine does not interfere with use of the weapon. A magazine which extends too far beneath the stock of a weapon may make it difficult or impossible to fire the weapon from a prone position. Additionally, reliable cartridge feeding mechanisms for larger magazines may be undesirably complex and difficult to manufacture.

One particularly effective device for use in carrying a spare magazine attached to an automatic firearm in a position of readiness for immediate use is described in Johnson U.S. Pat. No. 4,484,404. While such a device is readily useable with some types of automatic rifles, it is not so easily adapted for use with certain other automatic rifles, whose magazine retaining latch systems are not easily used to control a latch system of such a spare magazine holder. Such weapons utilize, for example, a fixed pin in the forward portion of the magazine well, in combination with a moveable latch located at the rear of the magazine well, so that a magazine is latched in place in the magazine well by using an upward motion followed by a rearward pivoting, or rocking, motion.

Schwaller U.S. Pat. No. 4,484,403 discloses a magazine which can be linked to another magazine alongside it in the same orientation, using mating pins and chocks. This arrangement, however, provides no protection for the open upper end of the magazine.

Musgrave U.S. Pat. Nos. 4,100,694 and 4,115,943 disclose spare magazine holders which retain spare magazines in locations forward of the service magazine of a repeating firearm, but require an undesirably long movement of a spare magazine to load it into place in the magazine well.

End U.S. Pat. No. 2,130,383 discloses a spare magazine held in a different orientation from that of a service magazine, thus requiring undesirable manipulation and wasting time before insertion of the spare magazine into the magazine well of a firearm is possible.

What is needed, therefore, is an improved easily-utilized device for retaining a loaded spare magazine in a position where it is immediately available, oriented ready to be inserted into a firearm as a service magazine, protected against foreign material, and held closely adjacent to the location where it is to be inserted into a firearm. Such a device should be low in cost, yet it must be entirely dependable and it should be useful with firearms of types with which the spare magazine holder of Johnson U.S. Pat. No. 4,484,404 is not easily used.

SUMMARY OF THE INVENTION

The present invention meets the need for an improved device for holding a loaded magazine for a firearm in a position of availability for quickly replacing a safety device of the type disclosed in Johnson U.S. Pat. No. 4,528,765, or for replacing an emptied service magazine of a semi-automatic rifle or the like, by providing a spare magazine retainer including a protective upper magazine-receiving part which may be mounted on an upper part of such a weapon for holding and covering the upper end of a magazine, in combination with a lower retaining element interconnecting the lower ends of the spare magazine and the service magazine or safety device, to hold a loaded spare magazine securely attached to the weapon as long as a service magazine or safety device is latched in place in the magazine well of the weapon. The protective upper portion of the device includes a protective top and sides which surround the open upper or out-feed end of the loaded magazine, excluding dirt from the spare magazine.

A magazine holder according to the invention holds a loaded magazine substantially alongside the location of the magazine well of the weapon with which it is associated, in terms of its position longitudinally of the firearm, although not necessarily at the same height as a magazine secured in the magazine well. A magazine released from the spare magazine holder of the invention is thus immediately in the proper position to be lowered, moved laterally, and raised into position in the magazine well.

In one preferred embodiment of the invention a rearwardly-projecting lug or pin is provided within the protective upper magazine-receiving portion of the device, in a position where it engages a hole or catch in the front side of the spare magazine in the same manner in which a lug or pin in the magazine well of the weapon engages the front of a service magazine. The cooperating lower retaining element, in such a preferred embodiment, is fastened to the spare magazine and includes a finger portion which extends laterally behind the service magazine, holding the lower end of the spare magazine rearward while the service magazine is in place in the magazine well of the weapon. The lower retaining element may be in the form of a loop which fits snugly around the lower portion of the spare magazine. When the service magazine is latched in place, the lower retainer element prevents the spare magazine from pivoting forward, and thereby retains the spare magazine alongside the magazine well of the weapon, supported by the rearwardly projecting pin within the magazine-receiving upper portion.

When the service magazine is released, as by operation of the magazine release mechanism of the weapon, the spare magazine is freed to pivot downward and forward about the pin within the protective upper portion of the spare magazine retaining device. The spare magazine is thereby released from the upper portion so that it may be inserted into the magazine well of the weapon. The lower retainer element remains on the spare magazine, from which it may be removed to be placed on another spare magazine, if desired.

In other embodiments of the invention the bottom ends of the spare magazine and service magazine are more securely fastened together at predetermined lateral and vertical relative positions so that the spare magazine is supported by the service magazine while it is engaged in the firearm.

In yet another embodiment of the invention, a magazine holder's lower retainer portion is connected with an externally visible safety device, which fits in the magazine well of a firearm in place of a magazine. This embodiment of the invention holds ready a loaded magazine, making ammunition immediately ready upon removal of the safety device from the magazine well of the firearm.

Both the upper portions and the cooperating lower retainers according to the invention may be made of a suitable plastics material which may be inexpensively molded in the required shapes.

It is therefore a primary object of the present invention to provide an improved protective carrier for holding a spare magazine attached to a firearm in a position ready for immediate use.

It is another important object of the present invention to provide a carrier providing protection against the entry of dirt and precipitation into contact with cartridges contained in a loaded spare magazine for an automatic weapon, while the spare magazine remains ready for immediate use.

It is an important feature of the present invention that it includes a protective upper portion mounted on a side of a weapon, laterally adjacent the location of the weapon's magazine well, to retain and protectively cover the open end of a magazine, in combination with a lower retainer element which holds the lower end of a spare magazine alongside the weapon without interfering with removal of a service magazine from the weapon or with use of the spare magazine after removal of the service magazine.

It is a principal advantage of the present invention that it retains a loaded magazine in position for quicker loading or reloading of an automatic weapon than has previously been possible in weapons of the types for which the present spare magazine retaining device is intended.

It is another advantage of the present invention that it provides protection for an immediately available spare loaded magazine more cheaply than has been possible previously.

The foregoing and other objectives, features, and advantages of the present invention will be more readily understood upon consideration of the following detailed description of the invention, taken in conjunction with the accompanying drawings.

BRIEF DESCRIPTION OF THE DRAWINGS

FIG. 1 is a perspective view taken from the left rear of a portion of a repeating rifle on which a spare magazine holder embodying the present invention is mounted.

FIG. 2 is a perspective view of the rifle and spare magazine holder shown in FIG. 1, taken from the upper left side of the rifle.

FIG. 3 is a perspective view, taken from the bottom right side, of the magazine-receiving upper portion of the spare magazine holder shown in FIGS. 1 and 2.

FIG. 4 is a perspective view, taken from the upper left side, of the lower retainer portion of the spare magazine holder shown on FIGS. 1 and 2.

FIG. 5 is a perspective view, taken from the lower right side of the rifle shown in FIG. 1 and 2, showing the rifle held with its barrel raised, with a spare magazine held in the spare magazine holder, before insertion of a service magazine into the magazine well of the rifle.

FIG. 6 is a perspective view, taken from the left rear, of a portion of the repeating rifle shown in FIG. 1, equipped with a spare magazine holder which is another embodiment of the present invention.

FIG. 7 is a perspective view, taken from the upper left side, of a magazine to which the lower retainer portion of the spare magazine holder shown in FIG. 6 is attached.

FIG. 8 is a perspective view, taken from the lower left front, of the rifle and spare magazine holder shown in FIG. 6.

FIG. 9 is a perspective bottom view of the rifle and spare magazine holder shown in FIG. 6.

FIG. 10 is a perspective top view of the protective upper magazine-retaining portion of the spare magazine holder shown in FIG. 6.

FIG. 11 is a partially cutaway perspective bottom view of the rifle shown in FIG. 6, together with the attached upper portion of the spare magazine holder shown in FIG. 6.

FIG. 12 is a perspective view of a repeating rifle equipped with yet another embodiment of the spare magazine holder of the present invention.

FIG. 13 is a right side elevational view of the lower end portion of a magazine equipped with the lower retainer portion of the spare magazine holder shown in FIG. 12.

FIG. 14 is a left side elevational view of the lower end of a magazine equipped with the lower retainer portion of the spare magazine holder shown in FIG. 12.

FIG. 15 is a front elevational view of the lower ends of a service magazine and a spare magazine connected to each other by the lower retainer portions of the spare magazine holder shown in FIGS. 12–14.

DETAILED DESCRIPTION OF THE INVENTION

Figure 16:
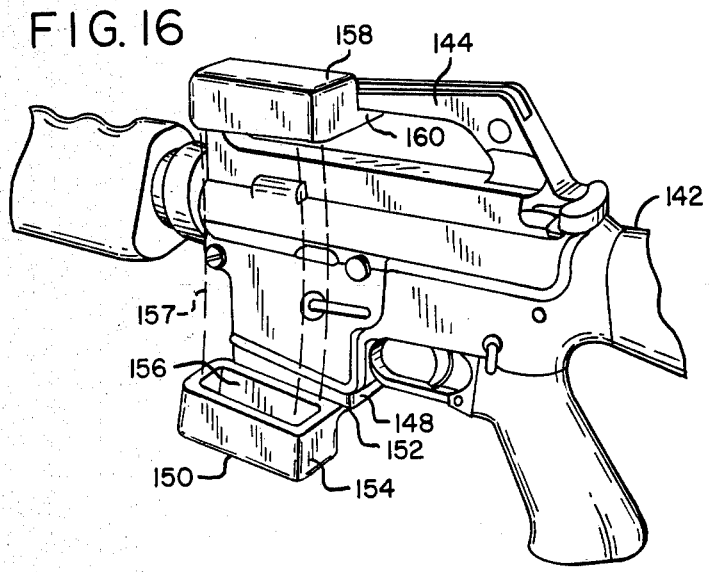
FIG. 16 is a perspective view of a rifle and a spare magazine holder embodying the invention and including an externally visible safety device latched in position in the magazine well of the rifle, as seen from the upper left rear of the rifle.
Figure 18:
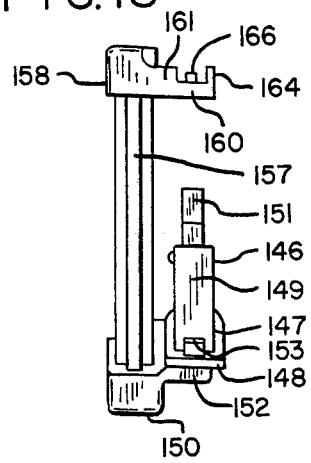
FIG. 18 is a rear elevational view of the spare magazine holder and externally visible safety device shown in FIGS. 16 and 17, together with a spare magazine.

Referring now to the drawings, a repeating rifle 10, for example a rifle such as a Ruger Mini-14 semiautomatic rifle having the usual barrel at its front end and a stock at its rear end, is shown in FIGS. 1, 2 and 5. A spare magazine holder embodying the present invention includes a protective magazine-receiving upper portion 12, also shown in FIG. 3, and a cooperating lower retainer portion 14, both of which may be of a suitable molded plastic. The lower retainer portion 14, also shown in FIGS. 4 and 5, is in the form of a loop 52 which fits around a spare magazine 16 and cooperates with the upper portion 12 to keep the spare magazine 16 engaged with the upper portion 12. An upper end 18 of the spare magazine 16 is protectively covered and held within the upper portion 12, so long as a service magazine 20 is securely latched in place in a magazine well 22 of the rifle 10. The spare magazine 16 is held alongside the magazine well 22 at a height which does not interfere with normal use of the rifle 10, and at a location along the front-to-rear length of the rifle which is substantially the same as the location of the magazine well 22.

The magazine-receiving upper portion 12 is attached to one side of the rifle 10 by a mounting bolt 24, which extends through a bore 25 in defined in the upper portion 12 and replaces a screw 26 ordinarily used to fasten the action of the rifle 10 in place in the stock 27 of the rifle. The mounting bolt 24 extends through the stock into the action of the rifle to hold the upper portion 12 to the stock while also holding the action in place in the stock 27 of the rifle 10. To prevent its loss, the screw 26 is secured in a threaded hole provided in the upper portion 12. A pair of locators, a longitudinally extending rear lip 28, and a similar front lip 30, extend horizontally along a top edge 32 of the rifle stock 27 to prevent the upper portion 12 from rotating about the mounting bolt 24. The upper portion 12 also includes a generally horizontal top portion 34 and a generally vertically extending rear wall 36, a side wall 38 and a front wall 40.

A pin 42 is mounted fixedly in the front wall 40, projecting rearwardly into a cavity 44 defined between the upper portion 12 and the stock 27 of the rifle 10. The pin 42 is located centrally of the width of the cavity 44 and a small distance below the inner, bottom surface of the top 34. Its position corresponds with the location of an aperture, 46, or catch, defined in a forward wall of a magazine such as the magazine 20 to help hold the magazine 20 in the magazine well 22 of a firearm such as the rifle 10. A downwardly projecting spacer member 48 is located on the bottom of the top portion 34, inside the cavity 44, to engage the magazine 16 or a cartridge contained therein so as to prevent rattling.

A circular boss 50 is located on a flange 51 which extends rearwardly, parallel with the stock of the rifle 10, beyond the rear wall 36. The boss 50 is of an appropriate size to fit within the hole ordinarily provided in the stock 27 to receive the screw 26 when the rifle 10 is not equipped with the spare magazine holder of the present invention.

The lower retainer portion 14 is in the form of a rectangular loop 52 which fits slidingly around the spare magazine 16. A pressure member 54, which is an enlarged portion of the loop 52, and a flexible portion 56 are included in the loop 52, which is of such a shape and size that it fits slidably but snugly on the spare magazine 16. The pressure member 54 presses against a side surface of the spare magazine 16 under the biasing force of elastic deformation of the material of which the loop 52 is made. A finger 58 extends laterally from the rear side of the loop 52, so as to be located behind the service magazine 20. Preferably, the finger 58 includes a forwardly directed hook portion 60 which extends forward on the side of the service magazine 20 opposite the spare magazine 16. A corner spacer portion 62 establishes a desired amount of lateral separation between the spare magazine 16 and the service magazine 20 and supports an upwardly projecting stud 64, which acts as a vertical spacer to limit upward movement of the loop 52 along the spare magazine 16. This ensures that there is clearance between the loop 52 and the bottom of the stock 27 of the rifle 10 sufficient for the magazine latch release lever 66 of the rifle to be operated to release the service magazine 20 from the magazine well 22.

Ordinarily the service magazine 20 is retained within the magazine well 22 by mating engagement of a rearwardly projecting member (similar to the pin 42, but not shown) located within the magazine well 22 in the aperture 46 of the service magazine, together with the engagement of a latch (not shown) located within the magazine well 22 in a latch receptacle located on a rear wall of the service magazine 20. The service magazine 20 is inserted upwardly into the magazine well until the aperture 46 engages the rearwardly projecting member inside the magazine well 22, after which the lower end of the service magazine is rotated rearwardly, with the aperture 46 as a fulcrum, until the latch in the magazine well 22 is engaged in the latch receptacle in the rear wall of the magazine 20.

Similarly, to use the spare magazine holder of the present invention, the aperture 46 in the front of a spare magazine 16 is fitted matingly over the pin 42 located within the cavity 44, and the spare magazine 16 is then pivoted, or rocked, rearwardly about the pin 42 until its reaches its proper orientation. When the spare magazine 16 is properly located, the downwardly projecting spacer 48 will slightly depress the cartridge follower or any cartridges held within the spare magazine 16, so that the cartridge follower spring of the magazine will bias the spare magazine 16 to rotate downwardly and forwardly if it is not held rearwardly by the lower retainer portion 14 of the spare magazine holder. Therefore, the upper end 18 of the spare magazine 16 is preferably inserted into place within the cavity 44 when the front end of the rifle 10 is elevated, as shown in FIG. 5. Once the spare magazine 16 has been properly located with its upper end 18 in the cavity 44 of the magazine-receiving upper portion 12, a service magazine 20 may be installed in the magazine well 22 in the normal manner, at which time the finger 58 will come into contact with the rear wall of the service magazine 20. As a result, the service magazine 20 prevents the spare magazine 16 from rocking forward and downward, the spare magazine 16 is supported, and its upper end 18 is protectively covered by the upper portion 12, with the aperture 46 of the magazine engaged on the pin 42 within the cavity 44.

If it is desired to remove the service magazine 20 from the magazine well 22 without releasing the spare magazine 16, it is only necessary to hold the weapon with its forward end upward, in which case the weight of the spare magazine 16 will retain the spare magazine in a position of engagement with the rearwardly projecting retaining pin 42 or similar member located within the upper portion.

Once the latch release lever 66 is operated, releasing the service magazine 20, both the service magazine 20 and the spare magazine 16 are free to rotate downwardly and forwardly about the respective apertures 46 in their front walls.

In replacing an empty service magazine, then, a rifleman would grasp the spare magazine 16 with his left hand while actuating the latch release lever 66. This allows the empty service magazine 20 to fall free from the magazine well 22, and simultaneously releases the spare magazine 16 into the rifleman's hand. The spare magazine 16 is immediately ready to be inserted into the magazine well 22 by merely moving it a slight distance toward the right and inserting it upwardly into the magazine well 22 in the usual manner. Because of the protective top 34 and the walls 36, 38, and 40 of the upper portion 12, foreign matter is excluded from the open upper end 18 of the spare magazine 16, and the rifleman is assured that the newly inserted magazine is ready for firing. Once the spare magazine 16 has been engaged in the magazine well 22 of the rifle 10, the lower retainer portion 14 may be removed from the magazine 16, to be saved or to be installed on another magazine which may be used thereafter as a spare magazine.

Referring now to FIGS. 6–11, in a second embodiment of the invention an upper portion 70 of suitable plastic material is mounted alongside the action of the rifle 10, above the top edge 32 of the stock. The upper portion 70 includes a top 72, a rear wall 74, an outside wall 76, a front wall 78, and an inside wall 80, which cooperatively define a generally rectangular cavity 82. A front flange 84 and a rear flange 86 extend generally in line with the inside wall 80, respectively, ahead of and behind the front and rear walls 78 and 74. A mounting bracket 88 of sheet metal extends generally parallel with the inside wall 80 and the front and rear flanges 84 and 86. A pair of mounting screws 90 extend through the flanges 84 and 86 and are threadedly engaged in the mounting bracket 88, securely connecting the front and rear flanges 84 and 86 to the mounting bracket 88. A mounting plate 92 of metal is attached fixedly, as by welding, to the mounting bracket 88. Respective front and rear vertical edges of the mounting plate 92 fit slidingly within corresponding grooves defined in the frame of the receiver of the rifle 10, replacing a removable cover plate which is ordinarily present in such a rifle, so that securing the receiver of the rifle into the stock 27 prevents the upper portion 70 from being removed from the rifle 10. Other means of attaching the upper portion 70 could be utilized in connection with particular rifles of different design. The important factor is that the upper portion 70 must be attached securely to a convenient side of the weapon at a location which permits the spare magazine 16 to be inserted upwardly into the cavity 82 to a height approximately similar to that of a service magazine 20′ engaged in the magazine well 22 of the rifle 10.

In this embodiment of the invention, a lower retainer portion 94 includes a loop 96, rectangular in shape, which is mounted on the service magazine 20′ by inserting the magazine 20′ upwardly through the loop and sliding the loop downwardly along the magazine until it comes to rest on an outwardly projecting rim 98 located where the floor plate 100 of the service magazine 20′ is attached. The lower portion 94 of the spare magazine holder extends laterally from the loop 96 and includes a spacer portion 102 and a cup portion 104 located parallel with and alongside loop 96. The cup 104 includes a bottom member 106 and an upstanding rim 108 large enough to fit upwardly around the bottom end 110 of the spare magazine 16. The bottom 106 is located at a height, with respect to the loop 96, which holds the upper end 18 of the spare magazine 16 within the cavity 82 when the service magazine 20 is latched in place in the magazine well 22.

A downwardly projecting spacer 112 (FIG. 11) is preferably provided within the cavity 82, on the underside of the top 72, to press downwardly upon cartridges within the spare magazine 16, compressing the cartridge follower spring of the spare magazine 16 to prevent the spare magazine from rattling.

Because the loop 96 fits snugly about the service magazine 20′, and because the upstanding rim 108 and the bottom 106 securely hold the bottom end 110 of the spare magazine 16, it is unnecessary in the upper portion 70 to provide a rearwardly extending pin such as the pin 42 disclosed in connection with the previously described spare magazine holder. As a result, the spare magazine holder shown in FIGS. 6–11 can be used to hold a spare magazine for a rifle which receives its magazine in a directly upward motion, as well as one which requires insertion of the magazine first upwardly and thereafter pivoting rearwardly.

Referring now to FIGS. 12–15, in a third embodiment of the present invention, an upper portion 120 is preferably similar to the upper portion 12 of the spare magazine holder shown in FIGS. 1–5. However, if operation of the magazine latch located in the magazine well of the rifle concerned requires only directly upward movement of a magazine it is not necessary for the upper portion 120 to have a pin corresponding to the pin 42 of the upper portion 12 described previously. The upper portion 120 is preferably attached to the rifle 10 by the use of a mounting bolt 122, while a screw 26 is stored in a hole provided. The upper portion 120 defines a cavity 44′ which receives the upper end 123 of a spare magazine 124.

To retain the lower end of the spare magazine 124 in a location parallel with and alongside a service magazine 126 engaged in the magazine well 22, a spacer stud 128 is located on the left side of each of the spare magazine 124 and service magazine 126. In a location on the right side of each of the spare magazine 124 and service magazine 126 is a chock 130, which, in the embodiment shown, has an upstanding rim wall 132 extending along three sides of a top plate 134 which defines a forwardly-open U-shaped throat 136. The spacer stud 128 and chock 130 may be made of materials corresponding to the materials of the magazine, for example, sheet steel welded to the sides of steel magazines. The throat 136 is wide enough to receive the shank 138 of the spacer stud 128, and the height of the rim wall 132 corresponds with the thickness of the head 140 of the spacer stud 128, so that the chock 130 slidingly receives the head 140 as the service magazine 126 is inserted and latched in place in the magazine well 22 of the rifle 10, after the upper end 123 of the spare magazine 124 has been inserted into the cavity 44′ of the upper portion 120. In the rifle 10, latching the service magazine 126 in place requires a rearward pivoting movement of the service magazine 126. This movement moves the spacer stud 128 of the service magazine 126 rearwardly into the forwardly open throat 136 on the adjacent right-hand side of the spare magazine 124, holding the lower end of the spare magazine 124 rearward while the upper end 123 is supported by being mated with a rearwardly extending pin 125 similar to the pin 42 located in the cavity of the upper portion 120.

As may be seen in FIG. 15, the height of the spacer stud 128 on its side of a magazine will differ from the height of the chock 130 on the opposite side of the same magazine by the difference in respective heights of the spare magazine 124 and service magazine 126, as dictated by the location of the upper portion 120 alongside the action of the rifle 10.

It will be appreciated that for rifles whose magazines are latched in place in their magazine wells simply by an upwardly directed motion, the chock 130 on the associated magazine would face either upward or downward, as determined by the side of the magazine on which the chock is located. The determining factor is that the chock 130 and the spacer stud 128 must mate so that the service magazine 126 holds the spare magazine 124 in the required position with its upper end 123 within the cavity 44′ of the upper portion 120 of the spare magazine holder. Similarly, it will be appreciated that the chock 130 would face rearwardly, were it on the left side and the spacer stud 128 on the right side of a spare magazine 124 and service magazine 126 intended for use with the rifle 10, which requires a rearwardly pivoting movement of the service magazine 126 to lock the service magazine 126 into position within the magazine well 22 of the rifle 10.

Referring now additionally to FIGS. 16–21, a further embodiment of the invention is shown in use with a repeating rifle 142, similar to the M-16 rifle used by the armed forces of the United States. The rifle 142 has a carrying handle 144 extending longitudinally and located spaced above its receiver. A downwardly-open magazine well is located at the bottom of the receiver of the rifle 142, and an object such as, preferably, an externally visible safety device 146 is located within the magazine well, where it is retained by a magazine-retaining latch which is a part of the rifle 142. The safety device 146 may be of the type shown in U.S. Pat. No. 4,528,765, of which the disclosure is incorporated herein by reference. It includes a bottom end 147 having a flange 148 which closes the open bottom end of the magazine well to exclude foreign material from the magazine well. A main body 149 fits into the magazine well and may be latched in place therein in the same manner in which a service magazine would be secured during use, as by engaging a catch 153 located on the rear of the main body 149. A top portion 151 extends above the main body, preventing the safety device 146 from being fully inserted into the magazine well unless the bolt of the rifle 142 is withdrawn rearwardly from its position in which it closes the breech of the barrel. Thus, the rifle 142 cannot be fired when the safety device 146 is in place in the magazine well.

Figure 17:
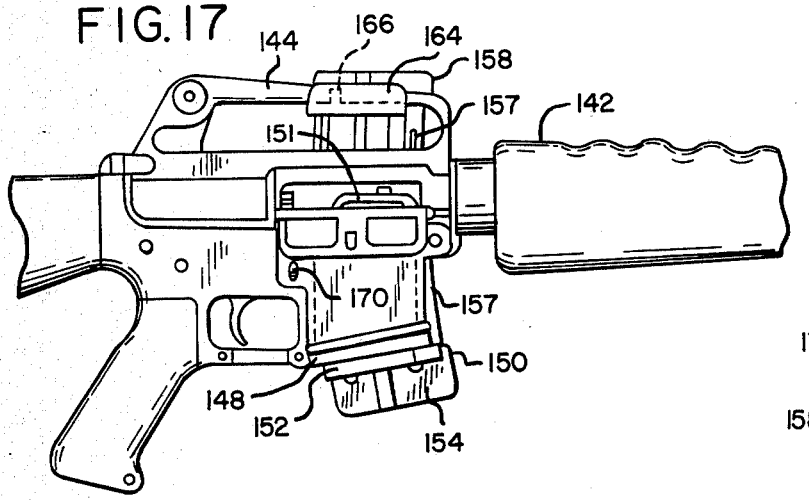
FIG. 17 is a right side elevational view of the spare magazine holder, externally visible safety device, and rifle shown in FIG. 16.
Figure 21:
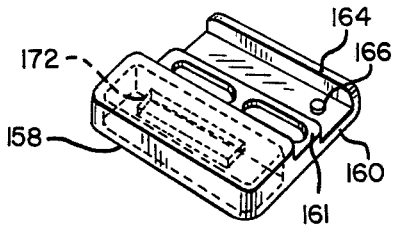
FIG. 21 is a perspective view, at an enlarged scale and taken from the upper left rear, of the magazine-receiving upper portion of the spare magazine holder shown in FIG. 16.
Figure 20:
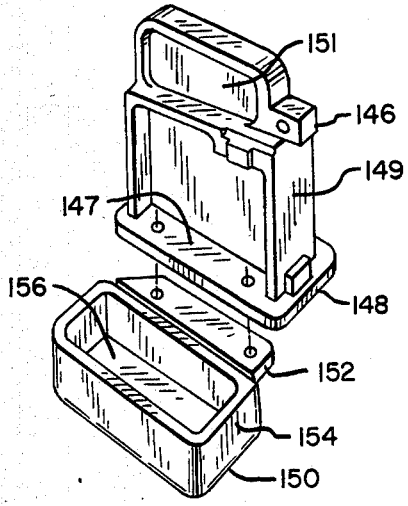
FIG. 20 is an exploded view, at an enlarged scale and taken from the upper left rear, of the lower retainer member of the spare magazine holder and externally visible safety device shown in FIG. 16.
Figure 19:
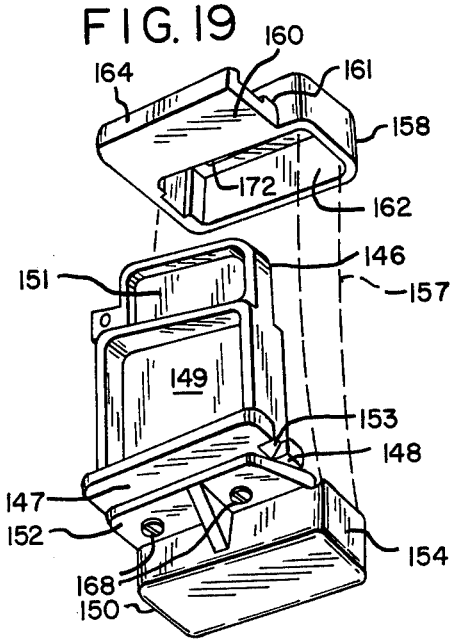
FIG. 19 is a perspective view, at an enlarged scale, of the externally visible safety device and spare magazine holder shown in FIG. 16, as seen from the lower right front.

Fixedly attached to the bottom end 147 of the safety device 146 is a lower magazine-receiving retainer portion 150 of this embodiment of the magazine holder of the invention. A bracket 152 which is a part of the lower retainer portion 150 extends laterally away from the flange 148 and supports an upwardly-open cup 154 defining a cavity 156 which is of an appropriate size and shape to receive the lower end of a magazine 157 for the rifle 142. The laterally extending bracket 152 of the lower retainer portion 150 may be attached to the flange 148 of the safety device 146 by suitable fasteners such as screws 168. The magazine 157 extends upwardly substantially vertically alongside the magazine well and the receiver of the rifle 142, as shown in FIG. 17, with its upper end being covered and enclosed by a protective magazine-receiving upper portion 158 of the magazine holder.

The magazine-receiving upper portion 158 includes a laterally extending arm 160 which extends beneath the carrying handle 144, as may be seen in FIG. 16. The laterally extending arm 160 includes a lateral spacer portion 161 which fits snugly alongside the carrying handle 144 to establish a lateral separation between the carrying handle 144 and a downwardly open cavity 162 defined within the upper portion 158, as may be seen in FIG. 19. An upwardly extending wall 164 is located alongside the opposite side of the carrying handle 144 to prevent the upper portion 158 from moving away from the carrying handle 144, the spacer 161 and wall 164 thus defining a channel between them. An upwardly extending locator pin 166 is located on the arm 160, in the channel between the spacer 161 and the wall 164, and extends upwardly through a preexisting bore defined in the carrying handle 144, thus locating the upper portion 158 with respect to the longitudinal dimension of the rifle 142.

The depth of the cavity 156 and the position of the bracket 152 with respect to the cup portion 154 are chosen with the height of the magazine 157 in mind, so that the bottom end of the magazine can be received snugly within the cavity 156 of the cup 154, while the upper end of the magazine 157 is received within the cavity 162 of the upper magazine-receiving portion 158, when the externally visible safety device 146 is latched in place in the magazine well of the rifle 142. The magazine 157 then holds the upper magazine-receiving portion 158 upward in mating engagement with the bottom of the carrying handle 144. The cavity 162 defined in the upper magazine-receiving portion 158 fits the magazine 157 sufficiently snugly to prevent the magazine-receiving upper portion 158 from tipping with respect to the magazine 157, and so long as the externally visible safety device 156 is latched in place in the magazine well of the rifle 142, the magazine-receiving upper portion 158 will remain securely engaged on the carrying handle 144, thus protectively holding the magazine 157 in place alongside the receiver of the rifle 142.

Since the externally visible safety device 146 can be latched in place in the magazine well of the rifle 142 only when the bolt of the action is displaced from the position required for discharge of a cartridge, as is explained in U.S. Pat. No. 4,528,765, the rifle 142 is safe, and the condition of safety can be visually verified from an appreciable distance, when a magazine 157 is carried by the spare magazine holder of this embodiment of the present invention.

However, when the magazine release latch button 170 on the right hand side of the rifle 142 (see FIG. 17) is pushed, the safety device 146 is released from the magazine well and drops downward, carrying with it the lower portion 150 of the spare magazine holder, releasing the spare magazine 157 to fall downwardly from the cavity 162 of the upper magazine-receiving portion 158. Without the magazine 157 holding the upper portion 158 upwardly against the bottom of the carrying handle 144, the upper portion 158 is free to drop away from its position beneath the carrying handle 144.

Thus, to prepare the rifle 142 to be fired, all that is necessary is to push the magazine latch release button 170 while grasping the loaded magazine 157, and once the externally visible safety device 146 and the lower portion 150 have fallen free from the magazine well, the upper end of the magazine 157 may be inserted into the magazine well and moved upwardly until the magazine is latched into position in the magazine well.

Preferably, the upper magazine-receiving portion 158 includes a downwardly projecting spacer 172 (FIGS. 19 and 21) which is located so that it will engage either cartridges contained within the magazine 157 or the cartridge follower of the magazine 157, so that the biasing force of the follower spring of the magazine 157 will prevent unnecessary rattling during use of the spare magazine holder of this embodiment of the invention.

It will be appreciated, furthermore, that the magazine-receiving upper portion 158 could be used in some cases in combination with a lower retainer portion such as the lower retainer portion 94 or with a combination such as the spacer stud 128 and chock 130.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A spare magazine holder for use with a repeating firearm of the type having a front end, a rear end, a pair of opposite sides and a magazine well located between said front and rear ends for receiving an upper end of a replaceable service magazine to hold a plurality of cartridges and feed them serially into position for being loaded into a firing chamber of the firearm, the spare magazine holder comprising:

(a) a magazine-receiving upper portion adapted to be mounted on a side of said firearm at a location laterally proximate said magazine well and at substantially the same longitudinal distance as said magazine well from said front and rear ends, said upper portion including means for receiving and holding an upper end of a spare magazine; and (b) lower retainer means spaced downwardly apart from said upper portion and extending laterally between a spare magazine and a service magazine held in said magazine well, for connecting a lower portion of said spare magazine with a lower portion of said service magazine and holding said spare magazine alongside and oriented generally parallel with said service magazine, with said upper end of said spare magazine extending upwardly into said magazine-receiving upper portion, only so long as said service magazine is held in place in said magazine well, and for releasing said spare magazine from said upper portion upon release of said service magazine from said magazine well.

2. The spare magazine holder of claim 1, said lower retainer means including laterally extending finger means for preventing said spare magazine from moving forward and downward relative to said magazine-receiving upper portion.

3. The spare magazine holder of claim 1, said lower retainer means including cup means attached to said service magazine, for preventing said spare magazine from moving downward relative to said magazine-receiving upper portion.

4. The spare magazine holder of claim 1 wherein said upper portion includes protective means for covering an outfeed end of a spare magazine and protecting said spare magazine against entry of contaminants thereinto.

5. A spare magazine holder for use with a repeating firearm of the type having a front end, a rear end, a pair of opposite sides and a magazine well located between said front and rear ends for receiving an upper end of a replaceable service magazine to hold a plurality of cartridges and feed them serially into position for being loaded into a firing chamber of the firearm, the spare magazine holder comprising:

(a) a protective magazine-receiving upper portion adapted to be mounted on a side of said firearm at a location laterally proximate said magazine well and at substantially the same longitudinal distance as said magazine well from said front and rear ends, said upper portion including means for receiving and holding an upper end of a spare magazine and covering said upper end to prevent entry of contaminants thereinto;

(b) an object having a shape and size adapted to fit in said magazine well in a predetermined position in place of a service magazine and including means for selectively retaining said object in such a location in said magazine well; and (c) lower retainer means spaced downwardly apart from said upper portion and extending laterally between a spare magazine and said object, for connecting said object with a lower portion of said spare magazine and holding said spare magazine alongside said object with said upper end of said spare magazine extending upwardly into said protective magazine-receiving upper portion, only so long as said object is held in place in said magazine well, and for releasing said spare magazine from said upper portion upon release of said object from said magazine well.

6. The spare magazine holder of claim 5 wherein said firearm includes a carrying handle, said object held in said magazine well being an externally visible safety device having an externally visible lower end portion extending downwardly beneath said magazine well, said lower retainer means including a laterally extending bracket fastened to said lower end portion.

7. The spare magazine holder of claim 6 wherein said magazine-receiving upper portion is free to separate from said carrying handle when said externally visible safety device is released from said magazine well, and wherein said lower retainer means and said magazine-receiving protective upper portion are of such sizes that said magazine-receiving upper portion is attached to said carrying handle by being supported by said spare magazine when said externally visible safety device is held in said magazine well by said magazine retaining latch.

8. The spare magazine carrier of claim 6 wherein said means for selectively retaining includes a magazine retaining latch and wherein said externally visible safety device includes catch means for mating with said magazine retaining latch for retaining said externally visible safety device within said magazine well.

9. The spare magazine holder of claim 6 wherein said externally visible safety device includes flange means for excluding foreign matter from said magazine well while said externally visible safety device is located in said magazine well.

10. The spare magazine holder of claim 6 wherein said externally visible safety device comprises a main body capable of fitting within said magazine well and top portion means attached to said main body, for preventing a bolt of said firearm from moving to a closed position necessary for said firearm to be fired, so long as said safety device is retained in said predetermined position in said magazine well, and for preventing said main body from being inserted fully into said magazine well when said bolt is in said closed position.

11. The spare magazine holder of claim 5, said magazine-receiving upper portion including laterally-extending means for releasably attaching said magazine-receiving upper portion to a carrying handle of said rifle.

12. The spare magazine holder of claim 11, said laterally extending means including locator means for engaging an opening in said carrying handle and holding said magazine-receiving upper portion in a predetermined position with respect to said carrying handle.

13. The spare magazine holder of claim 11 wherein said laterally-extending means includes a lateral spacer section and upwardly open channel means for receiving the bottom of said carrying handle of said rifle.

14. A spare magazine holder for use in conjunction with a firearm of the type having a front end, a rear end, a pair of opposite sides and a magazine well located between said front and rear ends for removably receiving a replaceable service magazine holding a plurality of cartridges to feed them serially into position for being loaded into a firing chamber of the firearm, the spare magazine holder comprising:

(a) a protective magazine-receiving upper portion adapted to be fastened to the firearm laterally proximate the location of a service magazine held in said magazine well and at substantially the same longitudinal distance as said magazine well from said front and rear ends, said upper portion defining a cavity therein for receiving an upper end of a spare magazine;

(b) rearwardly extending means located within said cavity in said magazine-receiving upper portion, for extending matingly into a corresponding aperture defined in a spare magazine for said firearm;

(c) lower retainer means, separate from said magazine-receiving upper portion, adapted to fit removably on a spare magazine for said firearm; and (d) a finger portion extending laterally from said lower retainer means and extending rearwardly adjacent said service magazine so as to prevent forward movement of said spare magazine so long as said service magazine is secured in a predetermined position in said magazine well.

15. The spare magazine holder of claim 14 wherein said lower retainer means includes a loop portion of such a size that it fits snugly on a spare magazine.

16. The spare magazine holder of claim 14 wherein said upper portion has a front wall which helps to define said cavity, said rearwardly extending means being located thereon.

17. The spare magazine holder of claim 14 wherein said lower retainer means includes upwardly projecting means for keeping said lower retainer means a predetermined distance below said upper portion.

18. The spare magazine holder of claim 14 wherein said lower retainer means includes upwardly projecting means for holding said lower retainer a sufficient distance below said upper portion to prevent said lower retainer means from interfering with a magazine latch release portion of said firearm.

19. The spare magazine holder of claim 14 wherein said firearm includes a stock, said upper portion being adapted to fit alongside said stock and defining a bore for receiving a fastener to attach said upper portion to said firearm, said protective upper portion further including front and rear locators adapted to fit against said stock ahead of and behind said bore, respectively, for stabilizing said upper portion relative to said stock.

20. The spare magazine holder of claim 14 including downwardly projecting means located within said upper portion, for exerting downward pressure against a spare magazine held by said spare magazine holder.

21. The spare magazine holder of claim 14 wherein said lower retainer means includes a loop of a size which fits slidingly around a spare magazine, said loop including pressure means for keeping said retainer means on said spare magazine and resilient means for holding said pressure means against said spare magazine.

22. The spare magazine holder of claim 14 wherein said lower retainer means includes cup means, attached to said service magazine and extending laterally there-from a predetermined distance, for fitting around and beneath a spare magazine and supporting it with an upper end of said spare magazine engaged in said magazine-receiving upper portion.

23. A spare magazine holder for use together with a firearm of the type having a front end, a rear end, a pair of opposite sides and a magazine well located between said front and rear ends for removably receiving a replaceable service magazine holding a plurality of cartridges so as to feed them serially into position for being loaded into a firing chamber of the firearm, the spare magazing holder comprising:

(a) a protective magazine-receiving upper portion adapted to be fastened to the firearm at a location laterally proximate said magazine well and at substantially the same longitudinal distance as said magazine well from said front and rear ends, and defining a cavity of appropriate size and shape for receiving an out-feed end of a spare magazine;

(b) a laterally-extending stud and means for attaching said stud to a side of a spare magazine, said stud including an enlarged head thereof spaced a predetermined distance apart from said side of said spare magazine; and (c) a laterally-extending chock attached to a service magazine, said chock defining U-shaped stud-receiving throat means spaced laterally apart from a side of said service magazine in a position aligned with said stud on said spare magazine, for receiving said stud and supporting said spare magazine when said spare magazine is engaged with said magazine-receiving upper portion and said service magazine is located in a predetermined position in said magazine well.

24. The spare magazine holder of claim 23 wherein said magazine-receiving upper portion includes a protective top portion, a forward wall, a rear wall, and a side wall defining said cavity for protectively covering an upper end of a spare magazine.

25. The spare magazine holder of claim 23 wherein said stud is welded to said side of said spare magazine and said chock is welded to said side of said service magazine at a location higher on said service magazine than the location of said stud on said spare magazine, said U-shaped throat means being upwardly open.

26. The spare magazine holder of claim 23, further comprising rearwardly-projecting means located within said magazine-receiving upper portion for mating with a corresponding aperture defined in a front portion of a spare magazine for said firearm.

* * * * *